US011959485B2

(12) United States Patent
Kuzdzal et al.

(10) Patent No.: US 11,959,485 B2
(45) Date of Patent: Apr. 16, 2024

(54) COMPRESSOR ROTOR STRUCTURE AND METHOD FOR ARRANGING SAID ROTOR STRUCTURE

(71) Applicant: Siemens Energy Global GmbH & Co. KG, Munich (DE)

(72) Inventors: Mark J. Kuzdzal, Allegany, NY (US); David J. Peer, Smethport, PA (US); Marcus Meyer, Duisburg (DE); Sebastian Huth, Mönchengladbach (DE); James M. Sorokes, Olean, NY (US); Kevin Miny, Essen (DE); Martin Reimann, Essen (DE); Roman Mensing, Düsseldorf (DE); Jesus Pacheco, Houston, TX (US); Steven Nove, Fulshear, TX (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 17/995,484

(22) PCT Filed: May 14, 2020

(86) PCT No.: PCT/US2020/032830
§ 371 (c)(1),
(2) Date: Oct. 5, 2022

(87) PCT Pub. No.: WO2021/230869
PCT Pub. Date: Nov. 18, 2021

(65) Prior Publication Data

US 2023/0175513 A1 Jun. 8, 2023

(51) Int. Cl.
*F04D 17/12* (2006.01)
*F04D 29/053* (2006.01)
(Continued)

(52) U.S. Cl.
CPC ..... *F04D 17/12* (2013.01); *F04D 29/053* (2013.01); *F04D 29/054* (2013.01); *F04D 29/286* (2013.01); *F04D 29/624* (2013.01)

(58) Field of Classification Search
CPC ..... F04D 17/12; F04D 17/122; F04D 29/053; F04D 29/054; F04D 29/286; F04D 29/624
See application file for complete search history.

(56) References Cited

U.S. PATENT DOCUMENTS 8,506,239 B2 * 8/2013 Benkler ..... F01D 5/066 415/110
8,967,960 B2 * 3/2015 Guenard ..... F04D 17/122 415/198.1

(Continued)

FOREIGN PATENT DOCUMENTS

DE 2844746 A1 4/1979
DE 102013110727 A1 4/2015

OTHER PUBLICATIONS

International Search Report and Written Opinion of the International Searching Authority dated Jan. 26, 2021 corresponding to PCT Application No. PCT/US2020/032830 filed May 14, 2020.

*Primary Examiner* — David E Sosnowski
*Assistant Examiner* — Jason G Davis
(74) *Attorney, Agent, or Firm* — Enrique J. Mora

(57) ABSTRACT

Compressor rotor structure and methodology for harmonizing compressor aerodynamics and rotordynamics are provided. Disclosed embodiments benefit from a compressor design effective for improving rotordynamics (e.g., stiffer rotor structure) without reducing a usable aerodynamics range of the compressor. This design may involve variation of the rotor structure along the rotor axis to locate respective surfaces defined by respective inlets of the one or more impellers at a varying distance relative to the rotor axis
(Continued)

based on respective ratios selected for the configuration of the impeller bodies. This arrangement may be effective for improving rotordynamics while satisfactorily meeting the respective varying aerodynamics requirements at the various compression stages by the impeller bodies.

16 Claims, 8 Drawing Sheets

(51) Int. Cl.

| | |
|---|---|
| ***F04D 29/054*** | (2006.01) |
| ***F04D 29/28*** | (2006.01) |
| ***F04D 29/62*** | (2006.01) |

(56) References Cited

U.S. PATENT DOCUMENTS

| | | | | |
|---|---|---|---|---|
| 10,508,547 | B2 * | 12/2019 | Rawe | F01D 5/066 |
| 10,718,212 | B2 * | 7/2020 | Jahrmarcht | F01D 5/026 |
| 11,136,896 | B2 * | 10/2021 | Benjamin | F16J 15/3208 |
| 2011/0262284 | A1 | 10/2011 | Guernard | |
| 2015/0316064 | A1 | 11/2015 | Kosamana et al. | |

* cited by examiner

COMPRESSOR ROTOR STRUCTURE AND METHOD FOR ARRANGING SAID ROTOR STRUCTURE

BACKGROUND

Disclosed embodiments relate generally to the field of turbomachinery, and, more particularly, to a rotor structure for a turbomachine, such as a compressor, and method for arranging the rotor structure Turbomachinery is used extensively in the oil and gas industry, such as for performing compression of a process fluid, conversion of thermal energy into mechanical energy, fluid liquefaction, etc. One example of such turbomachinery is a compressor, such as a centrifugal compressor.

BRIEF DESCRIPTION

Aspects of disclosed embodiments are directed to a rotor structure in a compressor. The rotor structure includes a tie bolt and two rotor shafts respectively affixed to respective ends of the tie bolt. A plurality of impeller bodies is supported by the tie bolt. A plurality of hirth couplings is used to mechanically couple the plurality of impeller bodies to one another along the rotor axis. A first impeller body of the plurality of impeller bodies is arranged to provide a first stage of compression, and each subsequent impeller body provides a subsequent stage of compression. Each respective impeller body defines a respective Di/D2 ratio. The Di/D2 ratio of at least one of the impeller bodies is different than the Di/D2 ratio of the remaining impeller bodies. Based on the different Di/D2 ratio, respective surfaces defined by the inlet of such impeller body are located at a different distance relative to the rotor axis compared to location of respective surfaces defined by the respective inlets of the remaining impeller bodies. Di is indicative of a respective inner diameter of a flow path into an inlet of a respective impeller body, and D2 is indicative of respective outer diameter of the respective impeller body.

In certain embodiments, a variation of the rotor structure along the rotor axis is based on a variation of respective Di/D2 ratios of one or more impeller bodies of the plurality of impeller bodies. The variation of the rotor structure along the rotor axis may involve locating the respective surfaces defined by the respective inlets of the one or more impeller bodies at a varying distance relative to the rotor axis. The location of the respective surfaces defined by the respective inlets of the one or more impeller bodies at the varying distance relative to the rotor axis is arranged to reduce or otherwise lower the inlet Mach number in the compressions stages by the one or more impeller bodies and adjust rotor stiffness along the rotor axis.

In certain embodiments, at least one spring biasing mechanism arranged to adjust radial stiffness at a respective location of the tie bolt. The respective location where the at least one spring biasing mechanism is arranged may be at or proximate the midspan section of the tie bolt.

In certain embodiments, a multi-nut-retaining arrangement may be involved. The multi-nut-retaining arrangement may be made up of at least two retaining nuts having a different diameter with respect to one another. The different diameter of the at least two retaining nuts is effective for configuring a radially-outward perimeter having a multi-step configuration in a respective rotor shaft of the two rotor shafts.

The multi-step configuration at the radially-outward perimeter of the respective rotor shaft defines a number of axially-extending segments in the respective rotor shaft, each of the axially-extending segments having a different diameter with respect to one another.

Further aspects of disclosed embodiments may be directed to a method for arranging a rotor structure of a compressor. The rotor structure includes a tie bolt and two rotor shafts respectively affixed to respective ends of the tie bolt. A plurality of impeller bodies is supported by the tie bolt. A plurality of hirth couplings is used to mechanically couple the plurality of impeller bodies to one another along the rotor axis. A first impeller body of the plurality of impeller bodies is arranged to provide a first stage of compression, and each subsequent impeller body provides a subsequent stage of compression. The rotor structure includes a tie bolt and two rotor shafts respectively affixed to respective ends of the tie bolt. A plurality of impeller bodies is supported by the tie bolt. The method allows arranging a first impeller body of the plurality of impeller bodies to provide a first stage of compression, and further allows arranging each subsequent impeller body to provide a subsequent stage of compression. Each respective impeller body defines a respective Di/D2 ratio. The Di/D2 ratio of at least one of the impeller bodies is different than the Di/D2 ratio of the remaining impeller bodies. Based on the different Di/D2 ratio, respective surfaces defined by the inlet of said impeller body are located at a different distance relative to the rotor axis compared to location of respective surfaces defined by the respective inlets of the remaining impeller bodies. Di is indicative of a respective inner diameter of a flow path into an inlet of a respective impeller body, and D2 is indicative of respective outer diameter of the respective impeller body.

In certain embodiments, the method allows arranging a variation of the rotor structure along the rotor axis based on variation of respective Di/D2 ratios of one or more of impeller bodies of the plurality of impeller bodies. The variation of the rotor structure along the rotor axis may involve locating the respective surfaces defined by the respective inlets of the one or more impeller bodies at a varying distance relative to the rotor axis. The locating of the respective surfaces defined by the respective inlets of the one or more impeller bodies at the varying distance relative to the rotor axis is arranged to reduce inlet Mach number in the compressions stages by the one or more impeller bodies and adjust rotor stiffness along the rotor axis.

DETAILED DESCRIPTION

Figure 1:
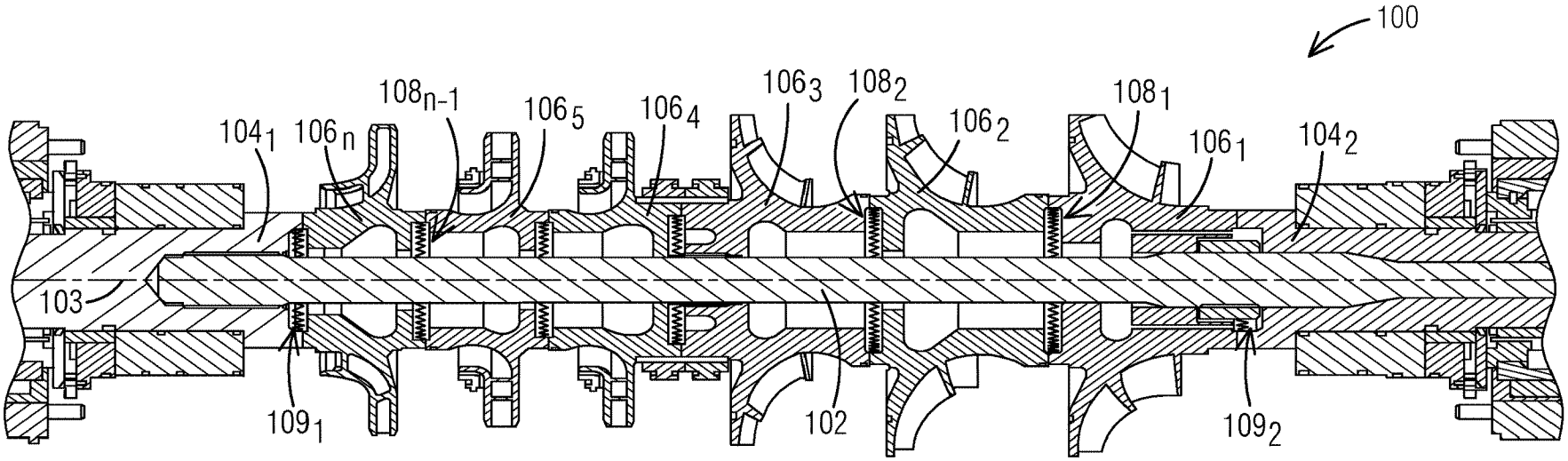
FIG. 1 illustrates a fragmentary cross-sectional view of one non-limiting embodiment of a disclosed rotor structure, as may be used in industrial applications involving turbomachinery, such as without limitation, centrifugal compressors.

As would be appreciated by those skilled in the art, turbomachinery, such as centrifugal compressors, may involve rotors of tie bolt construction (also referred to in the art as thru bolt or tie rod construction), where the tie bolt supports a plurality of impeller bodies and where adjacent impeller bodies may be interconnected to one another by way of elastically averaged coupling techniques, such as involving hirth couplings or curvic couplings. These coupling types use different forms of face gear teeth (straight and curved, respectively) to form a robust coupling between two components. These couplings and associated structures may be subject to greatly varying forces (e.g., centrifugal forces), such as from an initial rotor speed of zero revolutions per minute (RPM) to a maximum rotor speed, (e.g., as may involve tens of thousands of RPM).

The present inventors have recognized that attaining high performance and reliable operation in a centrifugal compressor may involve appropriately harmonizing or otherwise balancing the interaction of potentially conflicting design criteria, such as may involve rotordynamics and aerodynamics. Accordingly, disclosed embodiments benefit from an integrated approach conducive to harmonizing potentially conflicting design considerations, such as involving location of the flow passages (i.e., aerodynamics) and rotor stiffness (i.e., rotordynamics) in a centrifugal compressor.

The present inventors have further recognized that a compressor design that appropriately reduces the relative Mach-number at the inlet of a given impeller may be effective to achieve a desired efficiency over the useful flow range of the compressor (e.g., satisfactory aerodynamics performance from a minimum fluid flow to a maximum fluid flow). This low Mach-number design may involve a reduced Di/D2 ratio, where Di is indicative of a respective inner diameter of a flow path into the inlet of a respective impeller, and D2 is indicative of a respective outer diameter of the respective impeller. A reduced Di/D2 ratio permits locating the impeller's inlet area at a shorter distance relative to the rotor axis and this is beneficial from an aerodynamics perspective. However, such a low Mach-number design may entail a reduced rotor stiffness, such as, at least in part, due to the incrementally thinner structures that may be associated with a reduced size of Di.

Disclosed embodiments reliably and cost-effectively harmonize aerodynamics and rotordynamics by permitting sufficiently low inlet relative Mach numbers while maintaining sufficiently high rotor stiffness. A reduced Di/D2 ratio essentially allows "sinking" the aero flow path onto the rotor, which may be particularly beneficial at the first stage of compression in view of the challenging aerodynamics requirements typically encountered at the first stage of compression.

Disclosed embodiments can additionally accommodate respectively varying Di/D2 ratios for the respective stages of compression disposed along the rotor axis downstream from the first stage of compression. These respectively varying Di/D2 ratios may be tailored to harmonize aerodynamics and rotordynamics at each of such stages in an integrated and cohesive way. That is, a designer has the flexibility to make appropriate tradeoffs in disclosed embodiments to satisfactorily meet aerodynamics and rotordynamics requirements using a balancing approach.

In the following detailed description, various specific details are set forth in order to provide a thorough understanding of such embodiments. However, those skilled in the art will understand that disclosed embodiments may be practiced without these specific details, that the aspects of the present invention are not limited to the disclosed embodiments, and that aspects of the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

FIG. 1 illustrates a fragmentary cross-sectional view of one non-limiting embodiment of a disclosed rotor structure 100, as may be used in industrial applications involving turbomachinery, such as without limitation, compressors (e.g., centrifugal compressors, etc.).

In one disclosed embodiment, a tie bolt 102 extends along a rotor axis 103 between a first end and a second end of the tie bolt 102. A first rotor shaft $\mathbf{104}_1$ may be fixed to the first end of tie bolt 102. A second rotor shaft $\mathbf{104}_2$ may be fixed to the second end of tie bolt 102. Rotor shafts $\mathbf{104}_1$, $\mathbf{104}_2$ may be referred to in the art as stubs shafts. A plurality of impeller bodies 106, such as impeller bodies $\mathbf{106}_1$ through $\mathbf{106}_n$, may be disposed between rotor shafts $\mathbf{104}_1$, $\mathbf{104}_2$. In the illustrated embodiment, the number of impeller bodies is six and thus n=6; it will be appreciated that this is just one example and should not be construed in a limiting sense regarding the number of impeller bodies that may be used in disclosed embodiments. The embodiment illustrated in FIG. 1 involves a center-hung configuration of back-to-back impeller stages; it will be appreciated that this is just one example configuration and should not be construed in a limiting sense regarding the applicability of disclosed embodiments.

The plurality of impeller bodies 106 is supported by tie bolt 102 and is mechanically coupled to one another along the rotor axis by way of a plurality of hirth couplings, such as hirth couplings $108_1$ through $108_{n-1}$. In the illustrated embodiment, since as noted above, the number of impeller bodies is six, then the number of hirth couplings would be five. It will be appreciated that two additional hirth couplings $109_1$ and $109_2$ may be used to respectively mechanically couple the impeller bodies $106_n$, $106_1$ respectively proximate to the first and second ends of tie bolt 102 to rotor shafts $104_1$, $104_2$.

Figure 2:
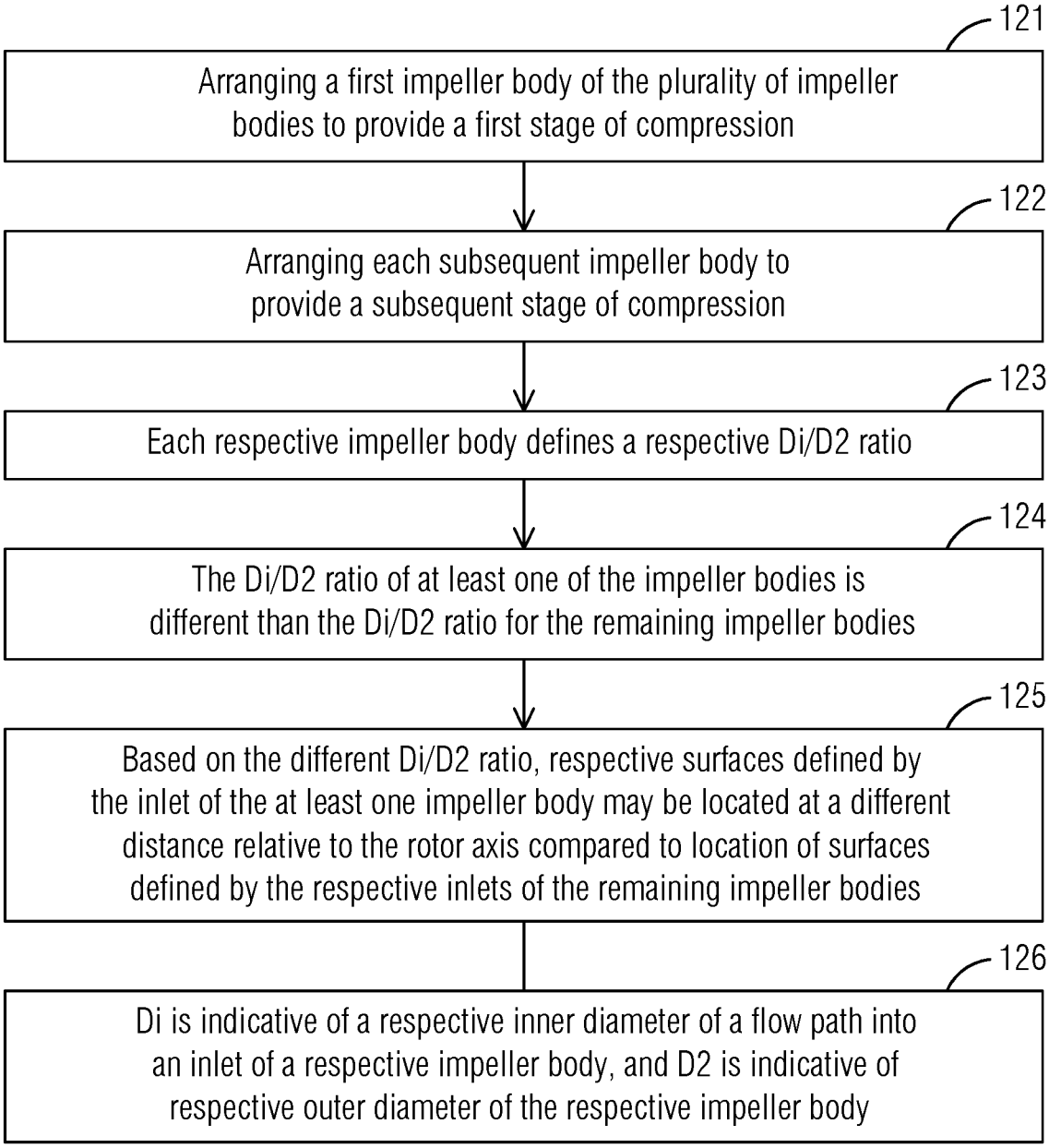
FIG. 2 illustrates a flow chart of a disclosed method including certain non-limiting steps for arranging a rotor structure of a compressor.

FIG. 2 illustrates a flow chart of a disclosed method for arranging a rotor structure of a compressor. Step 121 allows arranging a first impeller body (e.g., impeller body $106_1$ (FIG. 1)) of the plurality of impeller bodies to provide a first stage of compression. Step 122 allows arranging each subsequent impeller body to provide a subsequent stage of compression.

Figure 4:
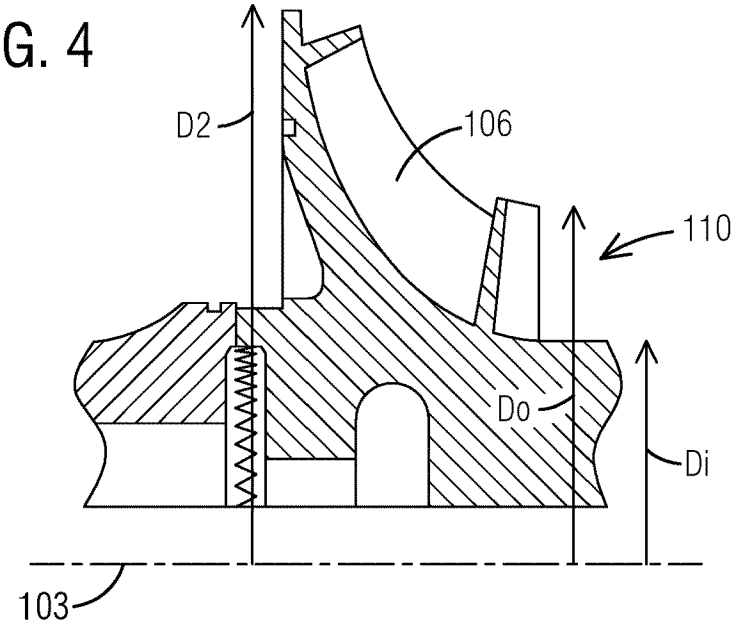
FIG. 4 illustrates a zoomed-in cross-sectional view of portions of an impeller body that may be used for illustrating and describing certain non-limiting structural and/or operational relationships implemented in the disclosed rotor structure.

As indicated in block 123, each respective impeller body defines a respective Di/D2 ratio. As indicated in block 124, the Di/D2 ratio of at least one of the impeller bodies is different than the Di/D2 ratio of the remaining impeller bodies. As indicated in block 125, based on the different Di/D2 ratio, respective surfaces defined by the inlet of the at least one of the impeller bodies may be located at a different distance relative to the rotor axis compared to the location of respective surfaces defined by the respective inlets of the remaining impeller bodies. As can be appreciated in FIG. 4 (and further indicated in block 126 in FIG. 2), Di is indicative of a respective inner diameter of a flow path into the inlet 110 of a respective impeller and D2 is indicative of a respective outer diameter of the respective impeller.

A reduced Di/D2 ratio permits locating the impeller's inlet area at a shorter distance relative to the rotor axis. Do is indicative of the outer diameter of the flow path into the inlet 110 of the respective impeller body 106. It will be appreciated that an adjustment in Di—to locate the inlet area at a desired location—can lead to an adjustment in Do.

Figure 3:
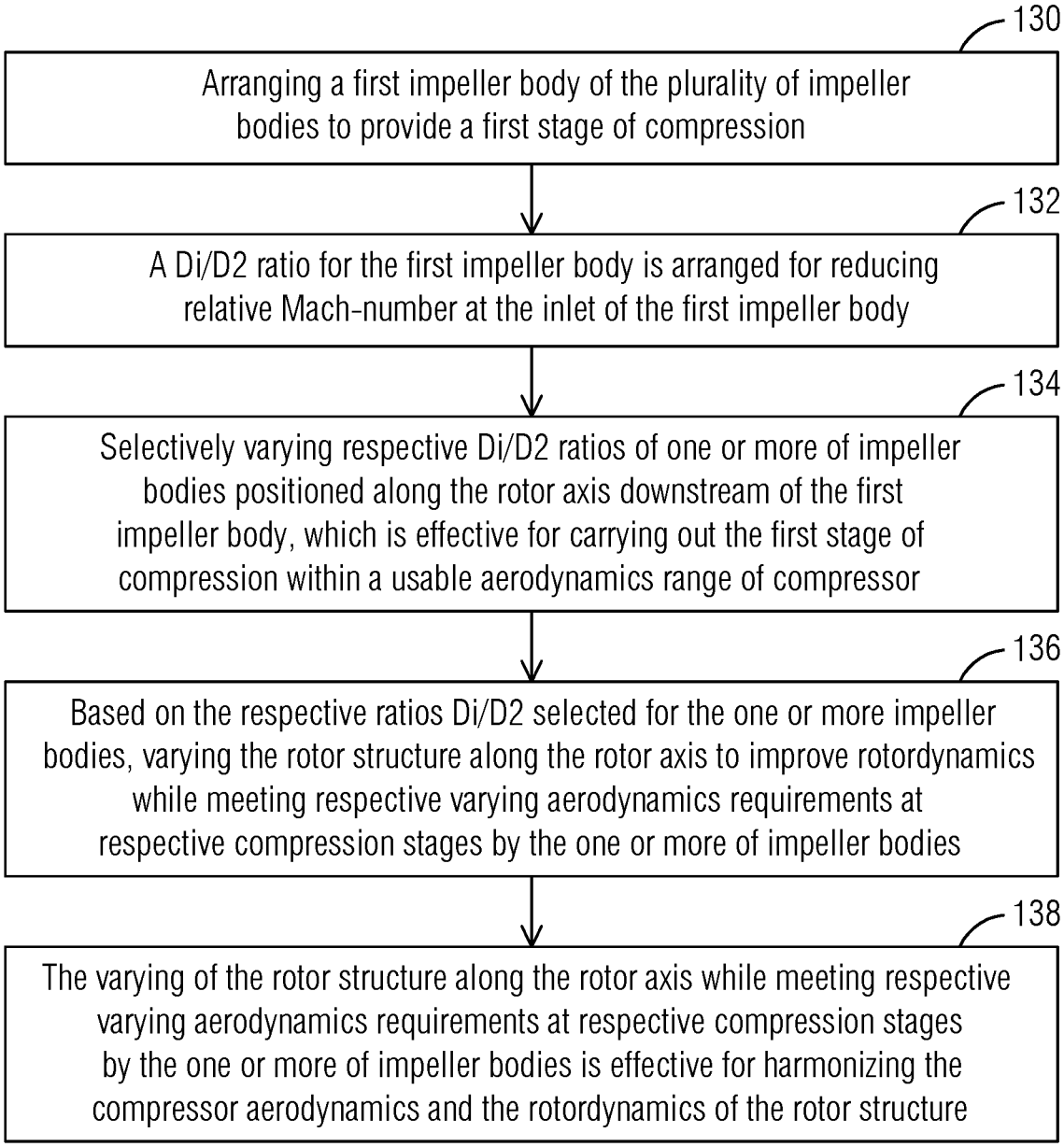
FIG. 3 illustrates a flow chart of one non-limiting example of a sequence of steps.

FIG. 3 illustrates one non-limiting embodiment, the disclosed method allows improving rotordynamics in the rotor structure without reducing a usable aerodynamics range of the compressor. Step 130 allows arranging a first impeller body (e.g., impeller body $106_1$ FIG. 1) of the plurality of impeller bodies to (provide a first stage of compression. Step 132 allows selecting a Di/D2 ratio for the first impeller body, where the selected Di/D2 ratio is arranged for reducing relative Mach-number at the inlet of first impeller body $106_1$. It will be appreciated that this is effective for carrying out the challenging first stage of compression within the usable aerodynamics range of the compressor.

Returning to FIG. 3, step 134 allows selectively varying respective Di/D2 ratios of one or more of impeller bodies, such as impeller bodies $106_2$ through $106_n$ (FIG. 1) positioned along the rotor axis downstream of the first impeller body $106_1$. That is, one has the flexibility to, for example, vary the Di/D2 ratio of just one impeller body or to, for example, vary the respective Di/D2 ratios of multiple impeller bodies, such as may include each of the impeller bodies disposed between rotor shafts $104_1$, $104_2$.

Based on the respective ratios Di/D2 selected for the one or more impeller bodies, step 136 allows varying the rotor structure along the rotor axis to improve rotordynamics while meeting respective varying aerodynamics requirements at respective compression stages by the one or more of impeller bodies. As noted in block 138, the varying of the rotor structure along the rotor axis while meeting respective varying aerodynamics requirements at respective compression stages by the one or more of impeller bodies, is effective for harmonizing the compressor aerodynamics and the rotordynamics of the rotor structure.

In one non-limiting embodiment, a respective range of ratio Di/D2 may vary from a value of 0.2 (or approximately 0.2) to a value of 0.65 (or approximately 0.65). In another non-limiting embodiment, a respective range of ratio Di/D2 may vary from a value of 0.25 (or approximately 0.25) to a value of 0.5 (or approximately 0.50). That is, the respective Di/D2 ratios defined by the respective impeller bodies can take any value within the foregoing ranges.

Figure 5:
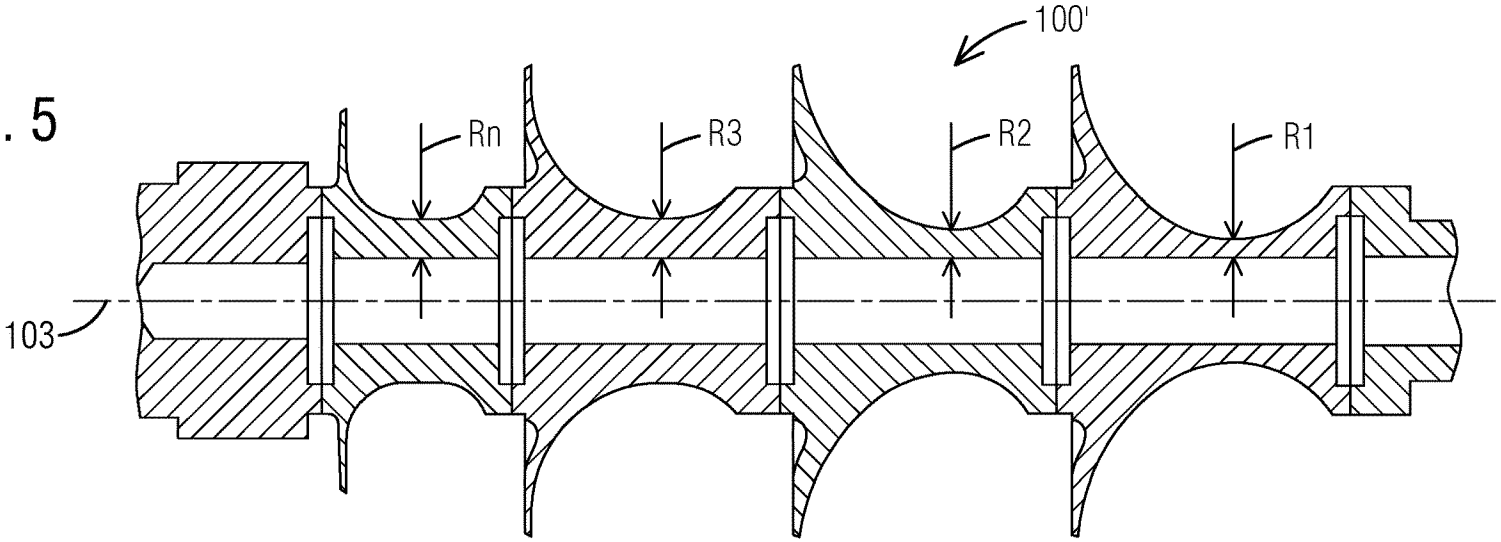
FIG. 5 illustrates a fragmentary cross-sectional view of another non-limiting example of a disclosed rotor structure.

FIG. 5 illustrates a fragmentary cross-sectional view of another non-limiting example of a disclosed rotor structure 100' that may be used for visually conceptualizing a varying of the respective ratios Di/D2 of the impeller bodies in connection with rotor structure 100'. For example, this allows varying the rotor structure along the rotor axis (e.g., stiffening the rotor structure, as schematically represented by arrows labeled R1 through Rn) and in turn allows improving rotordynamics while satisfactorily meeting the respective varying aerodynamics requirements at the respective compression stages by the impeller bodies.

In one non-limiting embodiment, the variation of the rotor structure along the rotor axis may comprise locating respective surfaces defined by respective inlets of the one or more impellers at a selectively varying distance relative to the rotor axis based on the respective Di/D2 ratios selected for the one or more of impeller bodies. The foregoing allows improving rotordynamics while satisfactorily meeting the respective varying aerodynamics requirements at the respective compression stages by the impeller bodies.

Figure 6:
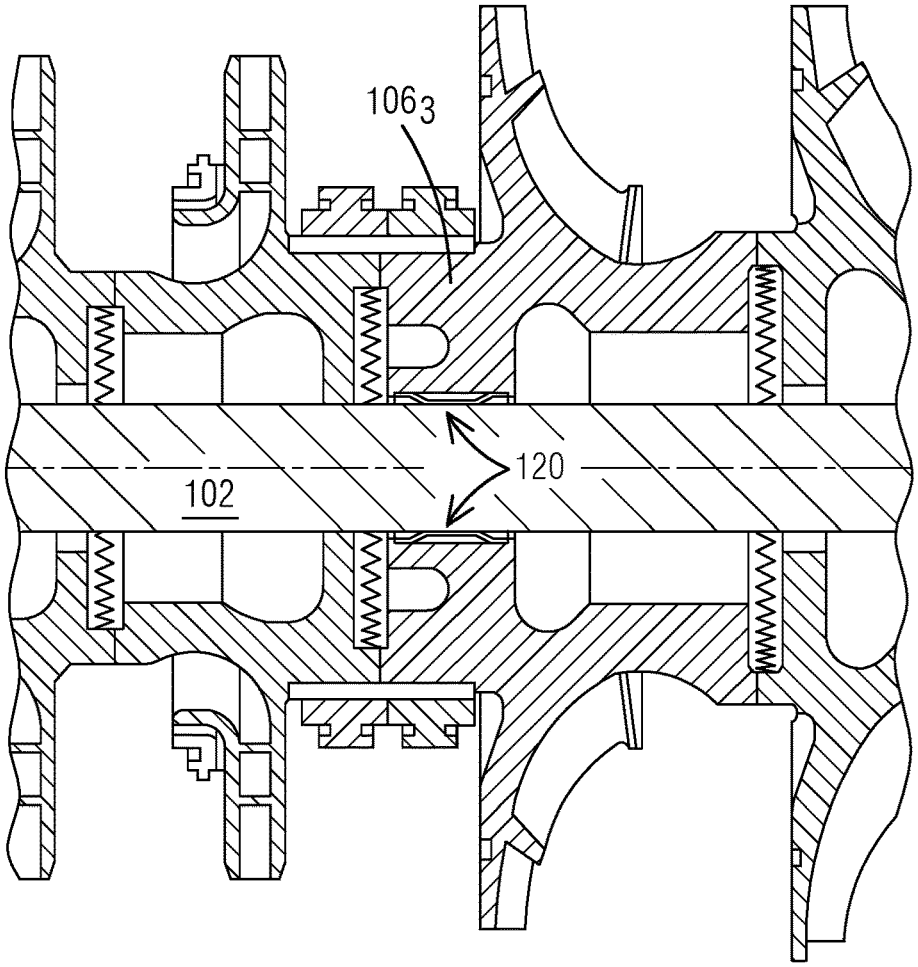
FIG. 6 illustrates a zoomed-in, cross-sectional view of the midspan section of a disclosed rotor structure.
Figure 7:
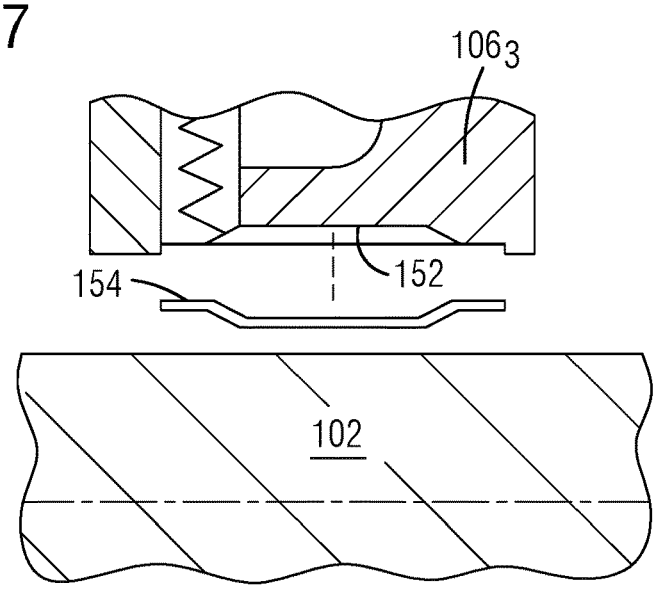
FIG. 7 illustrates a further zoomed-in, exploded view illustrating a non-limiting embodiment cross-sectional view of a spring biasing mechanism, such as a tolerance ring that may be arranged to adjust radial stiffness at the midspan section of the tie bolt.

FIG. 6 illustrates a zoomed-in, cross-sectional view including the midspan section 120 of the tie bolt 102 in a disclosed rotor structure. That is, a midsection of the tie bolt located substantially equidistant from the respective opposite axial ends of the tie bolt 102. As better appreciated in the further zoomed-in, exploded view illustrated in FIG. 7, without limitation, a tolerance ring 154 may be disposed at the midspan section of the tie bolt 102. This structural feature allows one to adjust radial stiffness at the midspan section of tie bolt 102, which in turn is effective to shift the natural frequency of the tie bolt away from the range of rotational speeds of the rotor.

It can be shown that the natural vibration frequency of a rotating body is determined by the square root of the ratio of stiffness to mass of the body. Thus, the increased radial stiffness provided by tolerance ring 154 is effective to reduce a possibility that the natural vibration frequency in a disclosed rotor structure would fall within the range of rotational speeds of the rotor, which, as would be appreciated by those skilled in the art, is a benefit to the rotordynamics of the rotor structure.

Figure 8:
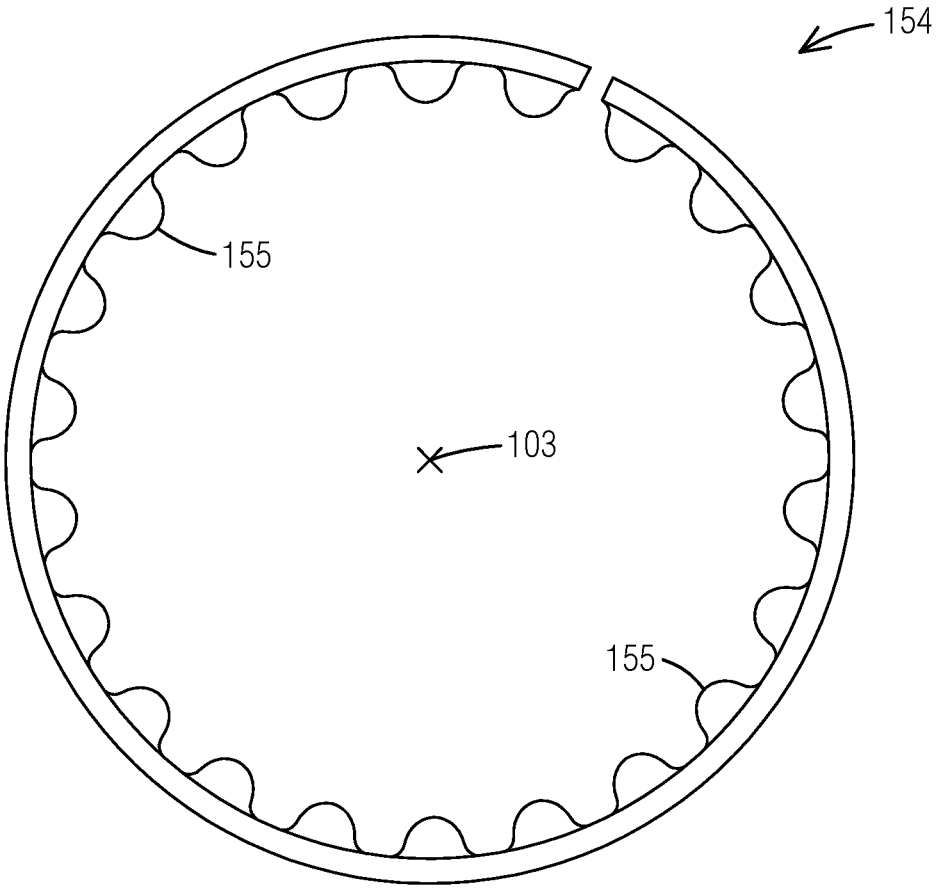
FIG. 8 illustrates a view of the tolerance ring about the rotor axis of the rotor structure.

In one non-limiting embodiment, a groove 152 may be defined at a radially-inner surface of impeller body 1063 (i.e., the impeller body disposed at the midspan of the tie bolt) to accommodate wave or corrugation features in tolerance ring 154. As may be better appreciated in FIG. 8, each corrugation 155 ("wave" or "bump") on tolerance ring 154 effectively acts as a stiff radial spring, and collectively such circumferentially disposed corrugations provide a desired radial stiffness at the midspan section of tie bolt 102. It will be appreciated that tolerance ring 154, as shown in the figures, is to be construed as one nonlimiting example of any one of a variety of modalities of spring biasing mechanisms that could be alternatively used to adjust the radial stiffness at the midspan section of the tie bolt 102.

It will be further appreciated that regardless of the modality, the spring biasing mechanism need not be limited to a singular spring biasing mechanism disposed at the midspan section of the tie bolt 102 since multiple spring biasing mechanism could be effectively used to provide radial stiffness at multiple locations of the tie bolt 102. For example, in certain alternative embodiments, without limitation, two spring biasing mechanism (e.g., two tolerance rings 154) may be disposed each at approximately ⅓ of the tie bolt length. Accordingly, it will be appreciated that the arrangement illustrated above should be construed as one non-limiting example for adjusting radial stiffness at one or more locations of tie bolt 102.

Further non-limiting examples of modalities of spring biasing mechanisms that may be used may include a wave spring, a C-shaped spring, a segmented O-ring, a spring energized segmented O-ring, a leaf spring, etc. It will be appreciated that any of such spring biasing mechanisms may be made-up of open or gapped structures that, for example, can permit fluid communication between neighboring chambers (e.g., internal chambers sharing boundaries with tolerance ring 154) and this reduces the possibility of pressure differentials that otherwise could develop between such chambers if a gasket-type of element, such as a monolithic O-ring, was used in lieu of an open structure. Without limitation, depending on the mechanical design of the rotor structure and the spring biasing mechanism, in certain embodiments, pressure equalizing vent paths may be disposed around the spring biasing mechanism.

Figure 9:
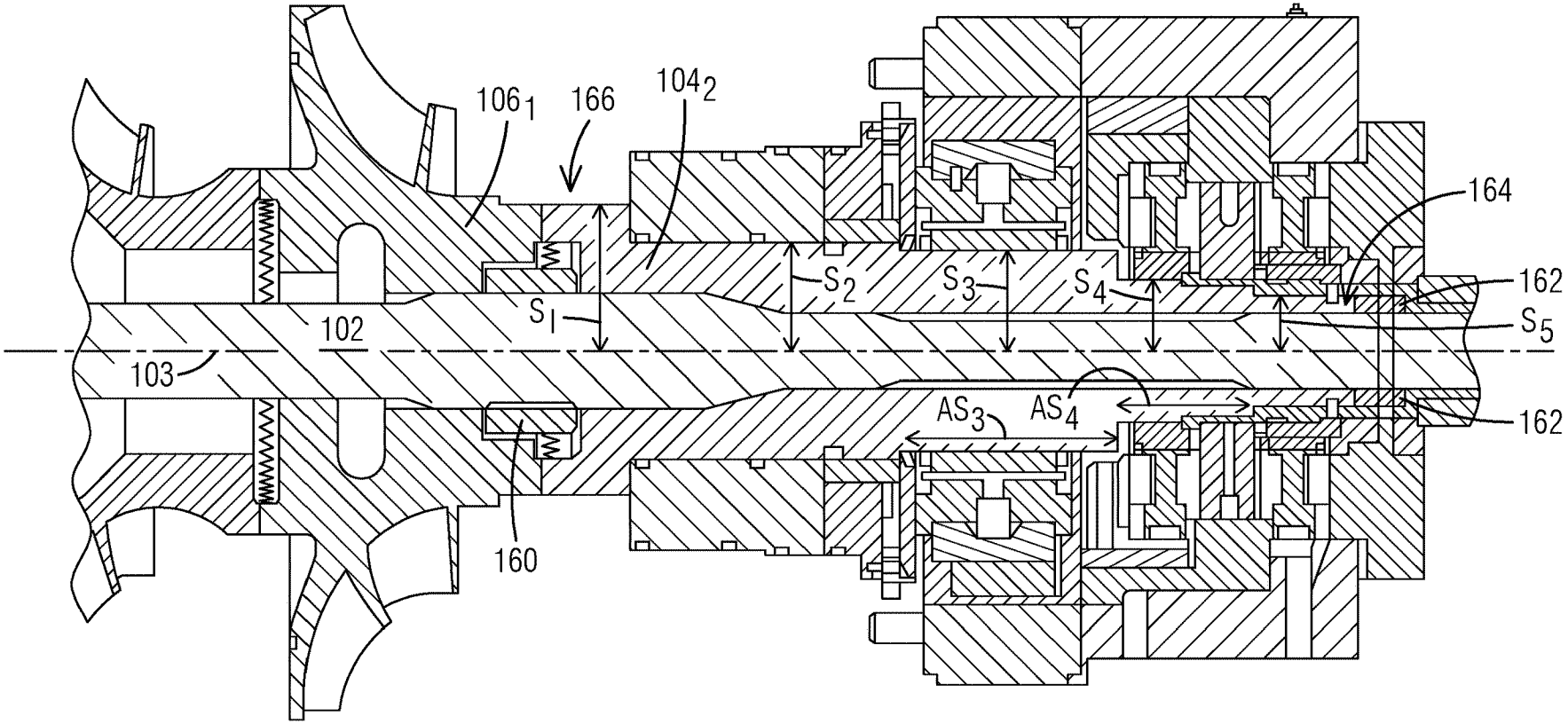
FIG. 9 illustrates a zoomed-in, cross-sectional view of one end of the tie bolt, which is supported by a rotor shaft, and where two or more retaining nuts having a different diameter may be arranged for implementing in the rotor shaft a radially-outward perimeter having a multi-step configuration.

FIG. 9 illustrates a zoomed-in, cross-sectional view of the second end of the tie bolt 102, which is supported by rotor shaft $\mathbf{104}_2$. In one non-limiting embodiment, a multi-nut-retaining arrangement may be used, which is effective for implementing in rotor shaft $\mathbf{104}_2$ a radially-outward perimeter having a multi-step configuration. Without limitation, this multi-nut-retaining arrangement may involve a main nut 160 that provides a threaded-connection with respect to tie bolt 102 and includes an axial face abutting against a corresponding axial face of first impeller body $\mathbf{106}_1$ and in effect retains the stack of impeller bodies at this end of the tie bolt 102.

Without limitation, the multi-nut-retaining arrangement may further involve a second nut 162 having a smaller diameter relative to the diameter of main nut 160. Without limitation, second nut 162 may provide a further threaded-connection with respect to tie bolt 102 and includes an axial face abutting against a corresponding axial face (e.g., at a proximate end 164) of rotor shaft $\mathbf{104}_2$ and in effect retains a distal end 166 (opposite the proximate end 164) of rotor shaft $\mathbf{104}_2$ against first impeller body $\mathbf{106}_1$.

As schematically represented by twin-headed arrows labeled S1 through S5, the multi-nut-retaining arrangement (e.g., involving at least two nuts) comprising different diameter sizes is effective to configure rotor shaft $\mathbf{104}_2$ with a radially-outward perimeter having a multi-step configuration along rotor axis 103. This allows reducing the respective diameters of a number of axially-extending segments in rotor shaft $\mathbf{104}_2$ (for the sake of avoiding visual cluttering, just two of such segments are schematically indicated in FIG. 9 by twin-headed arrows labeled with alphanumeric $AS_3$ and $AS_4$).

The foregoing arrangement in turn allows reducing respective diameters of journal bearings, thrust bearings and gas seals (e.g., part of a dry fluid seal system) respectively in correspondence with the axially-extending segments in rotor shaft $\mathbf{104}_2$. This diameter reduction is effective for attaining respective reductions in sliding speeds between moving components in the journal bearings, thrust bearings and gas seals, which is a feature conducive to superior durability and reliability of the foregoing components.

Figure 10:
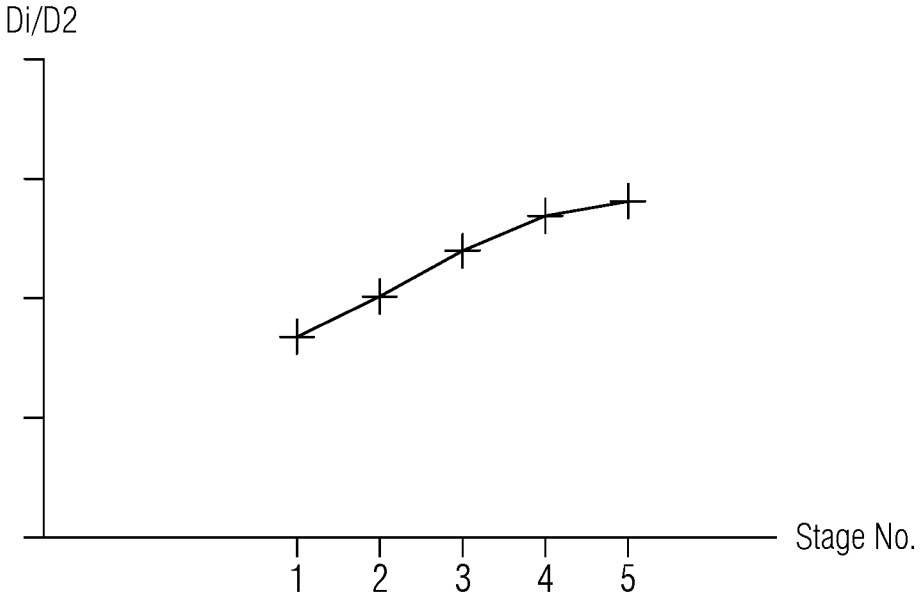
FIG. 10 is a plot of non-limiting example values of Di/D2 ratios as a function of compressor stages in one example application of a compressor process.

FIG. 10 is a plot of non-limiting example values of Di/D2 ratios as a function of compressor stages in one example application of a compressor process. In this example application, the compressor process involves a given mass flow, where the volume flow decreases as the process fluid is compressed as one progresses downstream relative to the first compression stage. In this application, the Di/D2 values would typically increase as one progresses downstream relative to the first compression stage.

Figure 11:
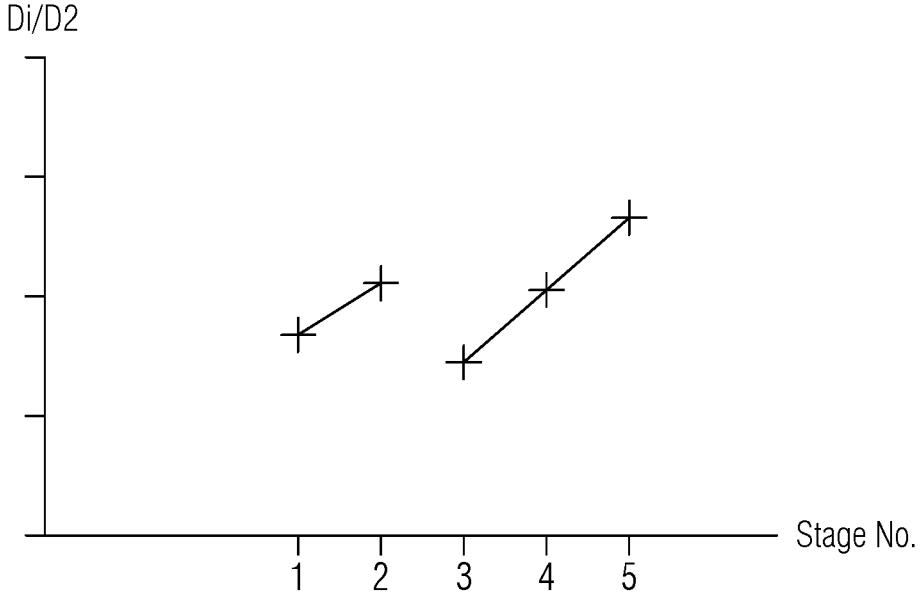
FIG. 11 is a plot of non-limiting example values of Di/D2 ratios as a function of compressor stages in another example application of another compressor process.

FIG. 11 is a plot of non-limiting example values of Di/D2 ratios as a function of compressor stages in another example application of a compressor process where there is a 'side stream in' were additional volume flow is injected into the compressor, such as at or near the middle of the rotor; let us presume prior to stage No. 3. In this application, prior to the injection of the additional volume flow, the Di/D2 values would increase, as noted above in the context of FIG. 10. Subsequent to the injection of the additional volume flow, the Di/D2 ratio would be adjusted (i.e., reduced) at stage No. 3 to account for the additional volume flow being injected prior to stage No. 3 and then the Di/D2 values for stages downstream from stage No. 3 would typically increase as noted above.

In operation, disclosed embodiments can make use of structural and/or operational relationships (e.g., adjusting respective Di/D2 ratios of the impellers) designed to harmonize potentially conflicting design considerations, such as involving the flow passages (i.e., aerodynamics) and rotor stiffness (i.e., rotordynamics) in a centrifugal compressor. Additionally, in operation disclosed embodiments can accommodate in a given rotor structure respectively varying Di/D2 ratios tailored to harmonize aerodynamics and rotordynamics at each of the compression stages in an integrated and cohesive way.

In operation, disclosed embodiments can make use of one or more spring biasing mechanisms arranged to adjust radial stiffness at respective locations of the tie bolt, which is a feature effective to reduce a possibility that the natural vibration frequency in a disclosed rotor structure would fall within the range of rotational speeds of the rotor.

In operation, disclosed embodiments can make use of a multi-nut-retaining arrangement for implementing in a rotor shaft a radially-outward perimeter with a multi-step configuration. This feature allows reducing the respective diameters of a number of axially-extending segments in the rotor shaft and in turn allows reducing respective diameters of journal bearings, thrust bearings and gas seals in correspondence with the axially-extending segments in the rotor shaft. Without limitation, this diameter reduction is effective for attaining respective reductions in sliding speeds between moving components in the journal bearings, thrust bearings and gas seals.

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. A rotor structure in a compressor, the rotor structure comprising:

a tie bolt and two rotor shafts respectively affixed to respective ends of the tie bolt;

a plurality of impeller bodies supported by the tie bolt; and a plurality of hirth couplings to mechanically couple the plurality of impeller bodies to one another along a rotor axis, wherein a first impeller body of the plurality of impeller bodies is arranged to provide a first stage of compression, and each subsequent impeller body provides a subsequent stage of compression, wherein each respective impeller body defines a respective Di/D2 ratio, wherein the Di/D2 ratio of at least one of the impeller bodies is different than the Di/D2 ratio of the remaining impeller bodies, wherein, based on the different Di/D2 ratio, respective surfaces defined by an inlet of said at least one of the impeller bodies are located at a different distance relative to the rotor axis compared to location of respective surfaces defined by respective inlets of the remaining impeller bodies, wherein Di is indicative of a respective inner diameter of a flow path into an inlet of a respective impeller body, and wherein D2 is indicative of respective outer diameter of the respective impeller body.

2. The rotor structure of claim 1, wherein a respective range of Di/D2 is from a value of 0.2 to a value of 0.65.

3. The rotor structure of claim 2, wherein a respective range of Di/D2 is from a value of 0.25 to a value of 0.50.

4. The rotor structure of claim 1, wherein a variation of the rotor structure along the rotor axis is based on a variation of respective Di/D2 ratios, wherein the variation of the rotor structure along the rotor axis comprises locating the respective surfaces defined by the respective inlets of the at least one of the impeller bodies at a varying distance relative to the rotor axis.

5. The rotor structure of claim 4, wherein the locating of the respective surfaces defined by the respective inlets of the one or more impeller bodies at the varying distance relative to the rotor axis is arranged to reduce inlet Mach number in the compressions stages by the one or more impeller bodies and adjust rotor stiffness along the rotor axis.

6. The rotor structure of claim 1, further comprising at least one spring biasing mechanism arranged to adjust radial stiffness at a respective location of the tie bolt.

7. The rotor structure of claim 6, wherein the respective location where the at least one spring biasing mechanism is arranged is at or proximate a midspan section of the tie bolt.

8. The rotor structure of claim 6, wherein the at least one spring biasing mechanism is selected from the group consisting of a tolerance ring, a wave spring, an O-ring, a segmented O-ring, a spring energized O-ring, a C-shaped spring, and a leaf spring.

9. The rotor structure of claim 1, further comprising a multi-nut-retaining arrangement, wherein the multi-nut-retaining arrangement comprises at least two retaining nuts having a different diameter with respect to one another, the different diameter of the at least two retaining nuts effective for configuring a radially-outward perimeter having a multi-step configuration in a respective rotor shaft of the two rotor shafts.

10. The rotor structure of claim 9, wherein the multi-step configuration at the radially-outward perimeter of the respective rotor shaft defines a number of axially-extending segments in the respective rotor shaft, each of the axially-extending segments having a different diameter with respect to one another.

11. A centrifugal compressor comprising the rotor structure of claim 1.

12. A method for arranging a rotor structure of a compressor, wherein the rotor structure comprises a tie bolt and two rotor shafts respectively affixed to respective ends of the tie bolt, and a plurality of impeller bodies supported by the tie bolt, the plurality of impeller bodies mechanically coupled to one another along a rotor axis by way of a plurality of hirth couplings, wherein the method comprises:

arranging a first impeller body of the plurality of impeller bodies to provide a first stage of compression, arranging each subsequent impeller body to provide a subsequent stage of compression, wherein each respective impeller body defines a respective Di/D2 ratio, wherein the Di/D2 ratio of at least one of the impeller bodies is different than the Di/D2 ratio for the remaining impeller bodies, wherein, based on the different Di/D2 ratio, respective surfaces defined by an inlet of said at least one of the impeller bodies is located at a different distance relative to the rotor axis compared to location of surfaces defined by respective inlets of the remaining impeller bodies, wherein Di is indicative of a respective inner diameter of a flow path into an inlet of a respective impeller body, and wherein D2 is indicative of respective outer diameter of the respective impeller body.

13. The method of claim 12, further comprising a variation of the rotor structure along the rotor axis based on a variation of respective Di/D2 ratios, wherein the variation of the rotor structure along the rotor axis comprises locating the respective surfaces defined by the respective inlets of the at least one of the impeller bodies at a varying distance relative to the rotor axis.

14. The method of claim 13, wherein the locating of the respective surfaces defined by the respective inlets of the one or more impeller bodies is arranged to reduce inlet Mach Number in the compression stages by the one or more impeller bodies and adjust rotor stiffness along the rotor axis.

15. The method of claim 12, wherein a respective range of Di/D2 is from a value 0.2 to a value of 0.65.

16. The method of claim 15, wherein a respective range of Di/D2 is from a value of 0.25 to a value of 0.50.

* * * * *